US005680657A

United States Patent [19]

Valtakari

[11] Patent Number: 5,680,657

[45] Date of Patent: Oct. 28, 1997

[54] PROTECTIVE PAD

[75] Inventor: Antti Valtakari, Siuro, Finland

[73] Assignee: L-Fashion Group Oy, Lahti, Finland

[21] Appl. No.: 586,481

[22] Filed: Jan. 16, 1996

Related U.S. Application Data

[63] Continuation of Ser. No. 205,396, Mar. 3, 1994, abandoned.

[30] Foreign Application Priority Data

Oct. 19, 1993 [FI] Finland ..... 934613

[51] Int. Cl.[6] ..... A41D 13/00

[52] U.S. Cl. ..... 2/455

[58] Field of Search ..... 2/2, 23, 267, 908, 2/911, 455; 36/3 R, 3 B

[56] References Cited

U.S. PATENT DOCUMENTS

| | | | |
|---|---|---|---|
| 2,344,762 | 3/1944 | Wylie | 36/3 R |
| 2,722,063 | 11/1955 | Drefvelin | 36/3 R |
| 4,185,402 | 1/1980 | Digate | 36/3 B X |
| 4,422,183 | 12/1983 | Landi et al. . | |
| 4,481,679 | 11/1984 | Hayes . | |
| 4,610,034 | 9/1986 | Johnson . | |
| 4,635,385 | 1/1987 | Ogden | 36/3 B X |
| 5,105,473 | 4/1992 | Valtakari . | |
| 5,405,312 | 4/1995 | Jacobs | 602/5 |

FOREIGN PATENT DOCUMENTS

| | | | |
|---|---|---|---|
| 307755 | 3/1929 | United Kingdom | 2/2 X |

OTHER PUBLICATIONS

International Publication No. WO 92/05717, dated Apr. 16, 1992 to Edward Krent et al.

*Primary Examiner*—Paul C. Lewis

*Attorney, Agent, or Firm*—Watson Cole Stevens Davis, P.L.L.C.

[57] ABSTRACT

A protective pad for an outfit equipped with separate protective pads that are inserted into pockets is composed of a cellular protective pad material having interconnected walls 2 in between which there are holes 3 that extend through the pad.

3 Claims, 1 Drawing Sheet

PROTECTIVE PAD

CROSS-REFERENCE TO RELATED APPLICATION

This application is a continuation of application Ser. No. 08/205,396, filed Mar. 3, 1994, now abandoned.

BACKGROUND OF THE INVENTION

1. Field of the Invention

The invention relates to a protective pad for an outfit equipped with separate protective pads that are inserted into pockets, which protective pad is composed of a flexible material that retains its shape.

2. The Prior Art

Separate pads are used with garments intended for different kinds of sports so that the person participating in the sport can be protected as well as possible against various kinds of falls, etc. For example, U.S. Pat. No. 5,105,473 discloses an outfit in which various protective pads of this kind are employed, depending on the usage.

It is often troublesome to manufacture protective pads for different uses because, on the one hand, they must be capable of bending and flexing according to the outfit, and, on the other hand, they must be able to provide adequate protection in the event of a fall or accident. Known protective pads are manufactured by injection-molding them one piece at a time, employing various structures in which between the fairly large shock-absorbing pads or cushions there are grooves which make the structure supple and flexible. Manufacturing protective pads with this structure is nevertheless expensive and slow, and furthermore it is difficult to optimize the protective properties.

SUMMARY OF THE INVENTION

An object of this invention is to provide a protective pad that is easy and simple to manufacture, is supple and flexible, and thus permits movement more easily when the pads are employed. A further object of the invention is to manufacture a protective pad whose protective properties can be selected as well as possible according to the usage and which additionally does not make the wearer perspire a great deal. The protective pad according to the invention is characterized in that it is composed of a cellular protective pad material which, in the thickness direction of the pad, comprises interconnected walls extending from its outer surface to its inner surface, the width of the walls in the direction of the pad surface being smaller than their height in the thickness direction of the pad, and that the walls form cells with a closed periphery such that between the walls of the cells there remain holes extending through the pad.

The essential idea of the invention is that the protective pad is made from a cellular board comprising either hexagonal or other appropriately shaped cells having walls which are the height of the pad and are interconnected such that a hole remains in between them. Further, according to a preferred embodiment of the invention, the protective pads are formed by cutting them out of a larger board containing such cells so as to produce a shape with the desired contour.

An advantage of the protective pad according to the invention is that it is fast and simple to make such a pad merely by manufacturing a board containing such cells and cutting out of it pads having the desired shape. If protective pads are manufactured in sufficiently great numbers, the pads can, of course, be manufactured advantageously also by employing, for each pad, molds in the form of a completed pad, whereby the pad is always made according to a specific shape. A further advantage of the protective pad according to the invention is that by selecting the form and thickness of the walls of the cells, during the manufacture of protective pad boards various protective and flexural properties of the protective pad can be selected to provide the desired protection. A still further advantage of the protective pad according to the invention is that it is permeable to steam and consequently affords the wearer of the outfit a more comfortable and perspiration-free state than in the prior art solutions.

BRIEF DESCRIPTION OF THE DRAWINGS

The invention will be described in more detail in the accompanying drawings, in which.

DETAILED DESCRIPTION OF THE PREFERRED EMBODIMENTS

Figure 1:
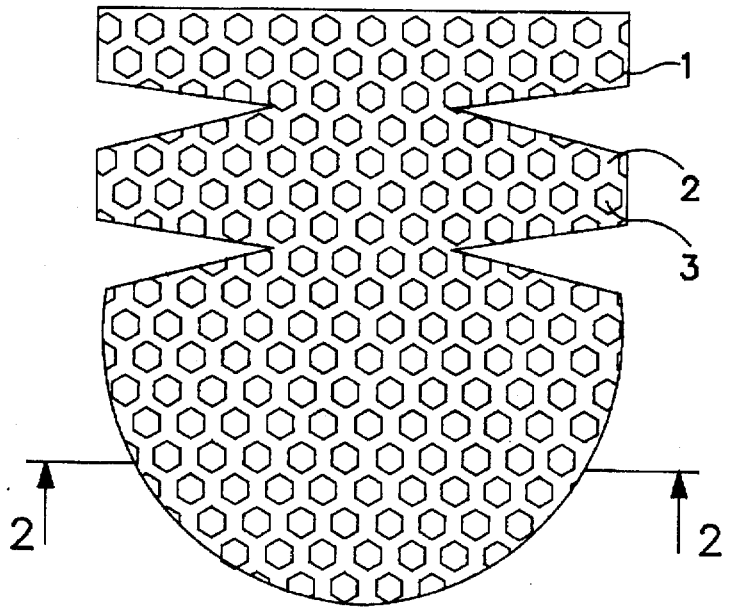
FIG. 1 is a schematic top view of a protective pad according to the invention.

FIG. 1 shows a protective pad which is formed by cutting it out of a larger board along outline 1 which is indicated in the figure. The protective pad has cells composed of cell walls 2, which are connected to the walls of the adjacent cells, forming a uniform cell-like structure substantially in the entire area of the pad. Each cell ordinarily has a hole 3 extending through the protective pad in its thickness direction.

When the protective pad is in use, the walls 2 of its cells contract inward upon impact, whereby they flex and are able to press into the holes 3. Thus, the protective pad flexes as needed, dampening the impact to a level that is reasonable for the wearer. When the effect of the impact has ceased, the walls 2 of the cells return to their original shape and position thanks to their resilience and are again ready to receive the next impact. When the wearer moves about, this generally results in some kind of perspiring, in which case the steam from the perspiration can escape via the holes 3 in the protective pad cells and does not collect on the inner surface of the protective pad so as to dampen clothing, as happens in the prior art solutions.

A protective pad according to the invention can be manufactured in a number of different ways. The pads can be manufactured, for example, by injection-molding them right from the beginning into protective pads having a specific contour, in which case each pad requires its own mold. A more advantageous method of manufacturing protective pads according to the invention is to produce cellular boards in the form of a large board comprising cells required for the pad. In this case, the protective pads can be manufactured merely by cutting pieces with the shape needed for the pad out of the board, thus further reducing the manufacturing expenses and the costs of the molds. Similarly, altering the shape of the protective pads due to changes in the structure or form of the garment is easier in this way than when making a separate mold for each protective pad. It is a consequence of both methods that the edgemost cells of the protective pad are not shaped the same as the other cells or their edges are not completely closed especially in the latter method of manufacture. This is nevertheless not of essential significance for the performance of the pad and it in no way affects the scope defined by the claims.

Figure 2:
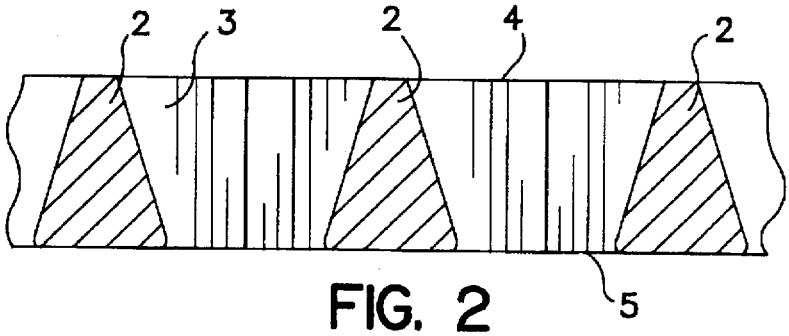
FIG. 2 is a schematic view of part of a protective pad according to the invention as a cross-section along line 2—2 in FIG. 1, and FIGS. 3*a* and 3*b* show certain other suitable cell structures for a protective pad according to the invention.

FIG. 2 shows part of a protective pad according to FIG. 1, as seen along section line 2—2. As shown in FIG. 2, the pad has, at predetermined intervals, parallel walls 2, which extend from the outer surface 4 of the pad to its inner surface 5. FIG. 2 also shows how the holes 3 of the cells extend from the outer surface of the pad to the inner surface. Thus, when an impact or force is applied to the pad, the walls 2, which are of a flexible material, can flex and press into the holes 3, whereby they at the same time dampen the effect of the impact on the wearer of the protective pad. The width of the walls 2 in the direction of the pad surface, i.e., from the hole 3 to the hole on the other side of the wall 2, is smaller than the height of the wall in the thickness direction of the pad in order to provide suitable flexure and shock-absorption for protective purposes. The figure shows a preferred embodiment of the invention. As shown in the figure, the width of the cell walls 2 increases starting from the outer surface 4 of the protective pad toward the inner surface 5, whereby their shock-absorbing effect increases simultaneously in the same direction. Concurrently, this provides a relatively large surface transmitting the impact and contiguous to the wearer's skin, whereby the effect is distributed over a larger area, and the consequences such as injuries are smaller than with a protective pad implemented in another manner.

Figure 3A:
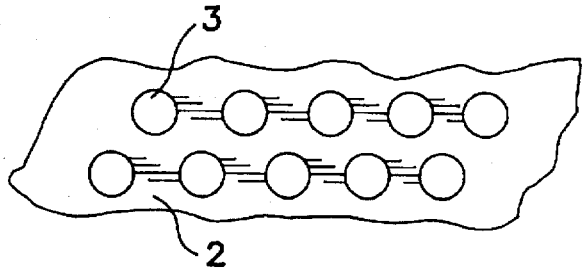
Figure 3B:
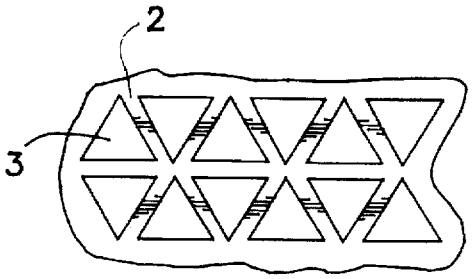

FIGS. 3*a* and 3*b* show two other types of cell suitable for manufacturing a protective pad according to the invention, whereby FIG. 3*a* shows a structure in which the holes 3 of the cells are round and the walls 2 between the holes 3 are formed in accordance with the edges of the holes. FIG. 3*b* in turn shows a cellular structure in which the holes of the cells are triangular, thus making the shape of the cell triangular, too.

In the above description and drawings, the invention has only been presented by way of example, and the invention is in no way limited thereto. The protective pads can be manufactured from substances having different shock-absorbing abilities, whereby they are suitable for different uses in different ways. The material of the protective pad can be rubber or plastic or some other suitably flexible material. One preferred cellular configuration of the protective pad is a hexagon because this provides, in an easy and efficient manner, an interconnected cellular structure with a shape offering a good shock-absorbing ability. Nevertheless, cells of some other shape, such as triangular, square etc. cells, can be contemplated. The protective pad according to the invention has the further advantage that the steam resulting from the wearer's perspiration can escape through the pad without remaining as moisture on the inner surface of the pad. The size of the holes running through the cells can nevertheless vary to quite a large extent, depending on the protective effect and the type of sport.

I claim:

1. A protective pad for an outfit equipped with separate protective pads that are inserted into pockets, said protective pad being composed of a flexible cellular protective pad material which retains its shape and is positioned relative to a user's body to provide an inner surface facing the body and an outer surface facing away from the body and a thickness direction therebetween, said pad defining interconnected walls which extend from said outer surface to said inner surface and have heights in the thickness direction which are substantially equal and widths which are smaller than their heights and increase in the direction from the outer surface to the inner surface, said walls forming cells with a closed periphery such that between the walls of the cells there remain holes extending through the pad.

2. A protective pad according to claim 1, wherein the walls (2) are arranged to form a hexagonal shape.

3. A protective pad according to claim 1, wherein the pad is formed from a board-like cellular material by cutting the material into a shape having the appropriate contour.

* * * * *